US008444456B2

(12) United States Patent
La Croix et al.

(10) Patent No.: US 8,444,456 B2
(45) Date of Patent: May 21, 2013

(54) ELECTRODE SECURING PLATENS AND ELECTRODE POLISHING ASSEMBLIES INCORPORATING THE SAME

(75) Inventors: Cliff La Croix, Livermore, CA (US); Armen Avoyan, Glendale, CA (US); Duane Outka, Fremont, CA (US); Catherine Zhou, Fremont, CA (US); Hong Shih, Walnut, CA (US)

(73) Assignee: Lam Research Corporation, Fremont, CA (US)

( * ) Notice: Subject to any disclaimer, the term of this patent is extended or adjusted under 35 U.S.C. 154(b) by 359 days.

(21) Appl. No.: 12/917,794

(22) Filed: Nov. 2, 2010

(65) Prior Publication Data

US 2012/0108152 A1 May 3, 2012

(51) Int. Cl.
*H01L 21/304* (2006.01)
*H01J 1/88* (2006.01)

(52) U.S. Cl.
USPC ..... 451/385; 118/723 E; 313/243; 451/398

(58) Field of Classification Search
USPC ..... 313/243, 238; 451/285, 287, 288, 451/290, 379, 384, 397, 398; 118/723 E, 118/723 R
See application file for complete search history.

(56) References Cited

U.S. PATENT DOCUMENTS

| | | | | |
|---|---|---|---|---|
| 6,073,577 | A | 6/2000 | Lilleland et al. | |
| 6,148,765 | A | 11/2000 | Lilleland et al. | |
| 6,194,322 | B1 | 2/2001 | Lilleland et al. | |
| 6,245,192 | B1 * | 6/2001 | Dhindsa et al. | 156/345.34 |
| 6,376,385 | B2 | 4/2002 | Lilleland et al. | |
| 6,506,254 | B1 | 1/2003 | Bosch et al. | |
| 6,638,359 | B2 | 10/2003 | Yajima et al. | |
| 7,543,547 | B1 | 6/2009 | Kennedy et al. | |
| 7,767,028 | B2 * | 8/2010 | Augustino et al. | 134/28 |
| 7,942,973 | B2 * | 5/2011 | Shih et al. | 134/1 |
| 8,075,701 | B2 * | 12/2011 | Avoyan et al. | 134/26 |
| 8,075,703 | B2 * | 12/2011 | Avoyan et al. | 134/28 |
| 8,171,877 | B2 * | 5/2012 | Augustino et al. | 118/503 |
| 8,276,604 | B2 * | 10/2012 | Augustino et al. | 134/137 |
| 2005/0241765 | A1 | 11/2005 | Dhindsa et al. | |
| 2007/0068629 | A1 | 3/2007 | Shih et al. | |
| 2007/0235660 | A1 | 10/2007 | Hudson | |
| 2007/0284246 | A1 | 12/2007 | Keil et al. | |
| 2008/0223401 | A1 | 9/2008 | Augustino et al. | |

OTHER PUBLICATIONS

PCT International Search Report and Written Opinion dated Jun. 29, 2012, PCT Application No. PCT/US2011/058745 filed Nov. 1, 2011, entitled Electrode Securing Platens and Electrode Polishing Assemblies Incorporating the Same Applicant: Lam Research Corporation et al.

* cited by examiner

*Primary Examiner* — Timothy V Eley
(74) *Attorney, Agent, or Firm* — Dinsmore & Shohl LLP

(57) ABSTRACT

In one embodiment, an electrode polishing assembly may include an electrode securing platen, a plurality of electrode locating fasteners, and an electrode. Each of the electrode locating fasteners may include an electrode spacing shoulder, a variance cancelling shoulder extending from the electrode spacing shoulder, a threaded platen clamping portion extending from the variance cancelling shoulder, and a threaded nut that engages the threaded platen clamping portion. The electrode locating fasteners clamp the electrode securing platen between the threaded nut and the electrode spacing shoulder. The variance cancelling shoulder is at least partially within one of a plurality of variance cancelling passages of the electrode securing platen. A minimum position stack-up is equal to a minimum passage size minus a maximum shoulder size. A maximum position stack-up is equal to a maximum passage size minus a minimum shoulder size. The maximum position stack-up is greater than the minimum position stack-up.

20 Claims, 2 Drawing Sheets

ELECTRODE SECURING PLATENS AND ELECTRODE POLISHING ASSEMBLIES INCORPORATING THE SAME

SUMMARY

The present disclosure relates generally to an electrode securing platen for use in processing electrodes and, more particularly, to an electrode securing platen for polishing multi-component electrodes that are used as excitation electrodes in plasma processing systems. Although the context of the present disclosure is not limited to particular types of electrodes or the context in which the electrodes to be polished have been used, for the purposes of illustration, the electrode securing platen is illustrated herein with reference to silicon-based electrode assemblies where an "outer," ring-shaped, silicon electrode is bonded to a backing plate. Those practicing the present invention will find that some of the polishing assemblies proposed herein will enjoy favorable utility in the context of a variety of types of electrodes and non-electrodes.

FIG. 1 illustrates an electrode polishing assembly 100 comprising an electrode 150 having an outer ring-shape. FIG. 2 illustrates a cross-section of the electrode polishing assembly 100. Further teachings regarding the structure of electrode assemblies similar to that illustrated in FIGS. 1 and 2 can be found in US Pub. Nos. 2007/0068629, 2007/0235660, and 2007/0284246, pertinent portions of which are incorporated herein by reference. Additional related teachings can be found in U.S. Pat. Nos. 6,073,577, 6,148,765, 6,194,322, 6,245,192, 6,376,385, and 6,506,254, and US Pub. No. 2005/0241765.

In one embodiment, an electrode polishing assembly may include an electrode securing platen, a plurality of electrode locating fasteners, and an electrode. The electrode securing platen may include an electrode facing surface, an assembly support surface, and a plurality of variance cancelling passages extending through the electrode securing platen from the electrode facing surface to the assembly support surface. The variance cancelling passages may be arranged at the electrode facing surface according to a plurality of hole-pattern locations. Each of the variance cancelling passages are no more than a platen tolerance distance away from one of the hole-pattern locations. Each of the variance cancelling passages may include a variance cancelling passage diameter. The variance cancelling passage diameter is greater than or equal to a minimum passage size and less than or equal to a maximum passage size. Each of the electrode locating fasteners may include a threaded electrode engagement portion, an electrode spacing shoulder extending from the threaded electrode engagement portion, a variance cancelling shoulder extending from the electrode spacing shoulder, a threaded platen clamping portion extending from the variance cancelling shoulder, and a threaded nut that engages the threaded platen clamping portion. The electrode may include a plurality of threaded orifices arranged at a platen facing surface according to the hole-pattern locations. Each of the threaded orifices are no more than an electrode tolerance distance away from one of the hole-pattern locations. Each of the electrode locating fasteners are engaged with the electrode and have a concentricity less than or equal to a concentric distance. The threaded electrode engagement portion may overlap one of the threaded orifices. The variance cancelling shoulder may include a positioning shoulder diameter. The positioning shoulder diameter is greater than or equal to a minimum shoulder size and less than or equal to a maximum shoulder size. The electrode locating fasteners clamp the electrode securing platen between the threaded nut and the electrode spacing shoulder. The variance cancelling shoulder is at least partially within one of the variance cancelling passages. A minimum position stack-up is equal to the minimum passage size minus the maximum shoulder size. A maximum position stack-up is equal to the maximum passage size minus the minimum shoulder size. The maximum position stack-up is greater than the minimum position stack-up.

In another embodiment, an electrode polishing assembly may include an electrode securing platen, a plurality of electrode locating fasteners, and an electrode. The electrode securing platen may include an electrode facing surface, an assembly support surface, and a plurality of variance cancelling passages extending through the electrode securing platen from the electrode facing surface to the assembly support surface. The variance cancelling passages may be arranged at the electrode facing surface according to a plurality of hole-pattern locations. Each of the variance cancelling passages are no more than a platen tolerance distance away from one of the hole-pattern locations. Each of the variance cancelling passages may include a variance cancelling passage diameter. The variance cancelling passage diameter is greater than or equal to a minimum passage size and less than or equal to a maximum passage size. Each of the electrode locating fasteners may include a threaded electrode engagement portion, an electrode spacing shoulder extending from the threaded electrode engagement portion, a variance cancelling shoulder extending from the electrode spacing shoulder, a threaded platen clamping portion extending from the variance cancelling shoulder, and a threaded nut that engages the threaded platen clamping portion. The electrode may include a plurality of threaded orifices arranged at a platen facing surface according to the hole-pattern locations. Each of the threaded orifices are no more than an electrode tolerance distance away from one of the hole-pattern locations. The threaded electrode engagement portion may include a thread pitch diameter. The thread pitch diameter of at least one of the electrode locating fasteners is within a lower 30% control band of a standard thread tolerance. Each of the electrode locating fasteners are engaged with the electrode and have a concentricity less than or equal to a concentric distance. The threaded electrode engagement portion overlaps one of the threaded orifices. The variance cancelling shoulder may include a positioning shoulder diameter. The positioning shoulder diameter is greater than or equal to a minimum shoulder size and less than or equal to a maximum shoulder size. The electrode locating fasteners may clamp the electrode securing platen between the threaded nut and the electrode spacing shoulder. The variance cancelling shoulder is at least partially within one of the variance cancelling passages A minimum position stack-up is equal to the minimum passage size minus the maximum shoulder size. A maximum position stack-up is equal to the maximum passage size minus the minimum shoulder size The minimum passage size is equal to a nominal variance cancelling passage diameter minus the platen tolerance distance minus a variance cancelling passage minimum tolerance. The maximum passage size is equal to the nominal variance cancelling passage diameter plus a variance cancelling passage maximum tolerance. The minimum shoulder size is equal to a nominal positioning shoulder diameter minus a minimum shoulder tolerance. The maximum shoulder size is equal to the nominal positioning shoulder diameter plus the concentric distance plus a maximum shoulder tolerance plus the electrode tolerance distance. The maximum position stack-up is greater than the minimum position stack-up. Additional embodiments of broader and narrower scope are contemplated.

BRIEF DESCRIPTION OF THE DRAWINGS

The following detailed description of specific embodiments of the present disclosure can be best understood when read in conjunction with the following drawings, where like structure is indicated with like reference numerals and in which.

DETAILED DESCRIPTION

As is noted above, the present disclosure relates to an electrode polishing assembly for polishing electrodes such as outer ring-shaped electrodes of multi-component electrodes. The concepts of the present disclosure should not be limited to particular electrode or electrode assembly configurations. With regard to the electrode 150, it is noted that reference herein to a silicon electrode or an electrode comprising silicon should be read to cover any of a variety of electrodes that utilize any of a variety of forms of silicon in their construction.

Figure 1:
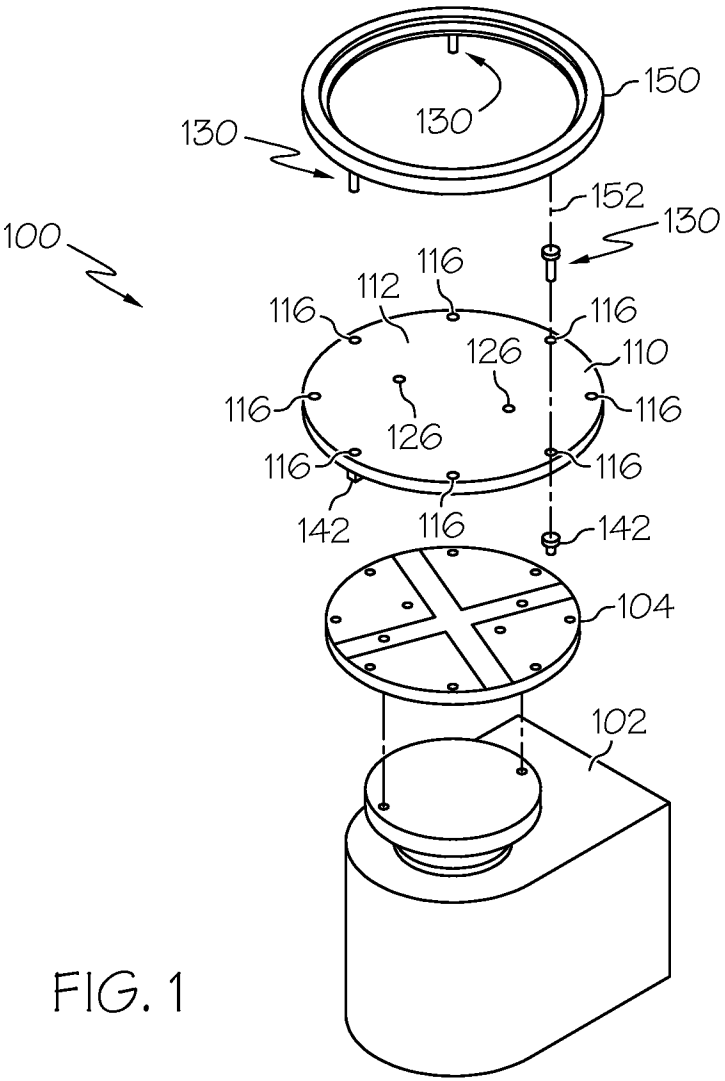
FIG. 1 depicts an exploded view of an electrode polishing assembly according to one or more embodiments shown and described herein.
Figure 2:
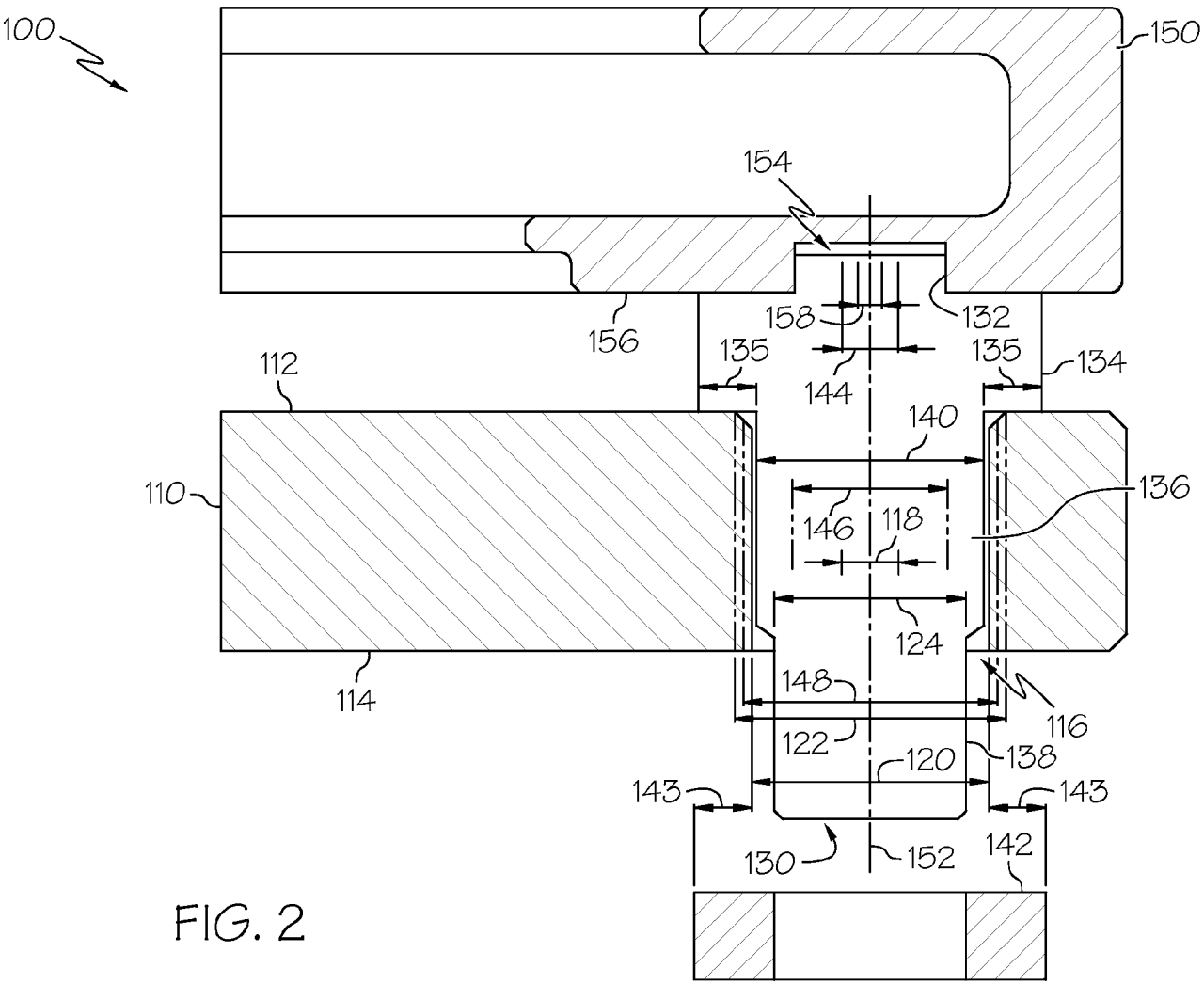
FIG. 2 depicts a cross-sectional view of an electrode polishing assembly according to one or more embodiments shown and described herein.

Referring collectively to FIGS. 1 and 2, an electrode polishing assembly 100 comprises an electrode securing platen 110, a plurality of electrode locating fasteners 130, and an electrode 150 such as, for example, a silicon outer ring-shaped electrode. The electrode securing platen 110 comprises an electrode facing surface 112 and an assembly support surface 114. A plurality of variance cancelling passages 116 extend through the electrode securing platen 110 from the electrode facing surface 112 to the assembly support surface 114. The variance cancelling passages 116 are arranged at the electrode facing surface 112 according to a plurality of hole-pattern locations 152. The hole-pattern locations 152 are depicted in the figures as a dashed line denoting a center line that is indicative of the target center line for machined holes. Such a center line may be commonly and idiomatically referred to as the nominal position or the "to print" position. For example, an electrode securing platen 110 may be manufactured according to a print (i.e., a design) that includes eight hole-pattern locations 152 that are equally spaced and form a circular arrangement.

Referring to FIG. 2, which depicts a cross-section of the electrode polishing assembly 100 focusing on one of the hole-pattern location 152, each of the variance cancelling passages 116 are no more than a platen tolerance distance 118 away from one of the hole-pattern locations 152. The center line of a variance cancelling passage 116 is aligned with a hole pattern-location 152 and is offset from the hole-pattern location 152 in the positive direction (depicted in FIG. 2 as to the right) or in the negative direction (depicted in FIG. 2 as to the left) by a distance that is less than or equal to the platen tolerance distance 118.

Each of the variance cancelling passages 116 comprises a variance cancelling passage diameter 120. The variance cancelling passage diameter 120 denotes the actual or as manufactured diameter of the variance cancelling passage 116. The variance cancelling passage diameter 120 is greater than or equal to a minimum passage size 124 and less than or equal to a maximum passage size 122.

Each of the electrode locating fasteners 130 comprise a threaded electrode engagement portion 132, an electrode spacing shoulder 134 extending from the threaded electrode engagement portion 132, a variance cancelling shoulder 136 extending from the electrode spacing shoulder 134, a threaded platen clamping portion 138 extending from the variance cancelling shoulder 136, and a threaded nut 142 that engages the threaded platen clamping portion 138.

The electrode 150 comprises a plurality of threaded orifices 154 arranged at a platen facing surface 156 according to the hole-pattern locations 152. Each of the threaded orifices 154 are no more than an electrode tolerance distance 158 away from one of the hole-pattern locations 152. The center line of a threaded orifice 154 is aligned with a hole pattern-location 152 and is offset from the hole-pattern location 152 in the positive direction or in the negative direction by a distance that is less than or equal to the electrode tolerance distance 158.

Each of the electrode locating fasteners 130 are engaged with the electrode 150, such that the threaded electrode engagement portion 132 overlaps one of the threaded orifices 154. In one embodiment, the threaded electrode engagement portion 132 and the threaded orifice 154 comprise corresponding threads and are threadingly engaged with one another. Each of the electrode locating fasteners 130 have a concentricity less than or equal to a concentric distance 144. That is, as the concentricity is measured along the threaded electrode engagement portion, the concentricity is less than or equal to the concentric distance 144 in the positive direction or in the negative direction.

The variance cancelling shoulder 136 comprises a positioning shoulder diameter 140. The positioning shoulder diameter 140 is greater than or equal to a minimum shoulder size 146 and less than or equal to a maximum shoulder size 148. The electrode locating fasteners 130 clamp the electrode securing platen 110 between the threaded nut 142 and the electrode spacing shoulder 134. The variance cancelling shoulder 136 is at least partially within one of the variance cancelling passages 116.

Referring still to FIG. 2, a minimum position stack-up is equal to the minimum passage size 124 minus the maximum shoulder size 148. A maximum position stack-up is equal to the maximum passage size 122 minus the minimum shoulder size 146. In the embodiments described herein, the maximum position stack-up is greater than the minimum position stack-up. The minimum position stack-up is a value that is indicative of the minimal amount of combined variation from nominal expected from the components of the electrode polishing assembly 100. A minimal radial slop is equal to one-half of the minimum position stack-up. The maximum position stack-up is a value that is indicative of the maximum amount of combined variation from nominal expected from the components of the electrode polishing assembly 100. A maximum radial slop is equal to one-half of the minimum position stack-up. In preferred embodiments, the minimum and maximum radial slop is selected such that the electrode 150 is constrained radially (relatively low radial slop) and the electrode polishing assembly 100 is easily assembled (relatively high radial slop).

In one embodiment, the minimum passage size 124 is equal to a nominal variance cancelling passage diameter (i.e., the ideal diameter of the variance cancelling passage 116) minus the platen tolerance distance 118 minus the variance cancelling passage minimum tolerance. In another embodiment, the maximum passage size 122 is equal to the nominal variance cancelling passage diameter plus a variance cancelling passage maximum tolerance. For the purpose of defining and describing the present disclosure, the term "tolerance" means permissible range of variation in a manufacturing dimension.

In an embodiment of the electrode polishing assembly 100, the minimum shoulder size 146 is equal to a nominal positioning shoulder diameter (i.e., the ideal diameter of the variance cancelling shoulder 136) minus a minimum shoulder tolerance. In another embodiment, the maximum shoulder size 148 is equal to the nominal positioning shoulder diameter plus the concentric distance 144 plus a maximum shoulder tolerance plus the electrode tolerance distance 158.

The threaded electrode engagement portion 132 comprises a thread pitch diameter. The thread pitch diameter is a diameter between the largest diameter of the thread and the smallest diameter of the thread. At the thread pitch diameter each pitch is substantially equally divided between mated external thread and internal threads. In one embodiment, the thread pitch diameter of at least one of the electrode locating fasteners 130 is within a lower 30% control band of a standard thread tolerance such as, for example, ISO metric screw standard, Unified Thread Standard, or any other commonly known thread standard. In a further embodiment, the thread pitch diameter of each of the electrode locating fasteners 130 is within the lower 30% control band of a standard thread tolerance. As used herein the term "control band" refers to a subset of the tolerance range of a standard thread size. For example, the threaded electrode engagement portion 132 may have an external threading and the threaded orifices 154 may have an internal thread matching the 7/16-28 size of the Unified Extra Fine (UNEF) standard. The thread pitch diameter specified by the UNEF standard is about 0.4114 inches (about 1.0450 cm)±about 0.0018 inches (about 0.0046 cm) with a maximum of about 0.4132 inches (about 1.0495 cm) and a minimum of about 0.4096 inches (about 1.0404 cm). The lower 30% control band encompasses the lowest 30% of the UNEF standard. Specifically, the lower 30% control band of the 7/16-28 size is about 0.4101 inches (about 1.0417 cm)±about 0.0005 inches (about 0.0013 cm) with a maximum of about 0.4106 inches (about 1.0429 cm) and a minimum of about 0.4096 inches (about 1.0404 cm). It is noted that, while the lower 30% control band is described herein according to a single size of the UNEF standard, the lower 30% control band may be computed in a similar manner for any standard thread size. Furthermore, the embodiments described herein may comprise any sized control band (i.e., any number from about 1% to about 99%) that facilitates mating with a threaded silicon electrode.

According to one embodiment, the variance cancelling shoulder 136 is substantially smooth (i.e., unthreaded). The electrode 150 may be fastened to the electrode securing platen 110 according to a heuristically determined number of electrode securing fasteners. In some embodiments, it is preferred to have the variance cancelling passages 116 outnumber the electrode locating fasteners 130. Thus, for example, when the electrode 150 comprises eight threaded orifices 154 the electrode polishing assembly may consist of any number of electrode locating fasteners 130 fewer than eight. For example, the electrode polishing assembly 100 may consist of five or fewer of the electrode locating fasteners 130.

Referring collectively to FIGS. 1 and 2, the electrode polishing assembly 100 may be coupled to a polishing machine 102 to recondition the electrode 150. The polishing machine is depicted as a machine with a rotating platen that may be coupled to a polishing machine adapter 104. In one embodiment, the electrode securing platen 110 is coupled to the polishing machine 102 via multiple adapter connection orifices 126. In this embodiment, it is preferred for the electrode 150 to be manually coupled to the electrode securing platen 110. Thus, the threaded nut 142 may be manually engageable and/or disengagable from the threaded platen clamping portion 138. A user exerting a manual force upon the manual engageable and/or disengagable nut as defined by the SEMI-S8 tip pinch standard, the pertinent portions of which are incorporated herein by reference, is capable of tightening and/or loosening the threaded nut 142. Such tightening and/or loosening engages and/or disengages the threaded nut 142 from the threaded platen clamping portion 138. In a further embodiment, the threaded nut 142 is provided with an underside clearance proximate to the threaded nut 142 and disposed between the assembly support surface and an obstruction (e.g., the polishing machine 102 or the polishing machine adapter 104) that provides access sufficient for manual tightening and/or loosening. Thus, the underside clearance should be large enough to provide manual access to the threaded nut 142 such as, for example, an underside clearance greater than or equal to about 3 inches (about 7.62 cm).

According to the embodiments described herein, the electrode polishing assembly 100 may be manually assembled for reconditioning. Once assembled, the electrode securing platen 110 is clamped between electrode spacing shoulder 134 and the threaded nut 142. The electrode spacing shoulder 134 comprises a spacing shoulder width 135. The overlap between the threaded nut 142 and the assembly support surface 114 forms a resting land when the threaded nut 142 is threadingly engaged with the threaded platen clamping portion 138 and in contact with the assembly support surface 114. The amount of force exerted by the clamping is partially defined by the spacing shoulder width 135 and the resting land width 143. In one embodiment, the spacing shoulder width 135 is greater than or equal to about 0.150 inches (about 0.381 cm) and the resting land width 143 is greater than or equal to about 0.190 inches (about 0.482 cm). For the purposes of describing and defining the present invention, it is noted that "reconditioning" operations generally refer to a variety of processes for treating a component and include, but are not limited to, chemical treatment, polishing, cleaning, etc.

To reduce the possibility of contamination during reconditioning procedures, the various assembly components described herein can be fabricated using materials that are resistant to oxidation or other process-related degradation. For example, and not by way of limitation, the materials should be chemically resistant to isopropyl alcohol, sulfuric acid, hydrogen peroxide, hydrofluoric acid, nitric acid, acetic acid, and the like. Suitable materials include, but are not limited to, polymers such as polypropylene and polycarbonate for components like the electrode locating fasteners 130 of the assembly that are likely to be subject to acute stress, strain, or wear.

It should now be understood, that the embodiments described herein may be utilized to secure a silicon electrode to a polishing machine with a relatively low number of electrode locating fasteners compared to the number of threaded orifices in the silicon electrode. In order to provide further clarity without limiting the scope of the embodiments described herein, the following twenty-five example cases were calculated according to exemplary dimensions and are summarized in the tables below.

Exemplary dimensions for the nominal variance cancelling passage, platen tolerance distance 118, variance cancelling passage minimum tolerance, variance cancelling passage maximum tolerance, maximum passage size 122 and minimum passage size 124 are provided in Table 1 (all units in inches) and Table 2 (all units in cm).

TABLE 1

| Example Number | nominal variance cancelling passage diameter | platen tolerance distance | variance cancelling passage minimum tolerance | variance cancelling passage maximum tolerance | maximum passage size | minimum passage size |
|---|---|---|---|---|---|---|
| 1 | 0.6300 | 0.0050 | 0.0050 | 0.0050 | 0.6350 | 0.6200 |
| 2 | 0.8442 | 0.0084 | 0.0084 | 0.0084 | 0.8526 | 0.8274 |
| 3 | 0.7214 | 0.0065 | 0.0065 | 0.0065 | 0.7278 | 0.7085 |
| 4 | 0.6647 | 0.0056 | 0.0056 | 0.0056 | 0.6702 | 0.6536 |
| 5 | 0.7844 | 0.0075 | 0.0075 | 0.0075 | 0.7918 | 0.7695 |
| 6 | 0.7592 | 0.0071 | 0.0071 | 0.0071 | 0.7662 | 0.7451 |
| 7 | 0.7529 | 0.0070 | 0.0070 | 0.0070 | 0.7598 | 0.7390 |
| 8 | 0.8757 | 0.0089 | 0.0089 | 0.0089 | 0.8846 | 0.8579 |
| 9 | 0.8883 | 0.0091 | 0.0091 | 0.0091 | 0.8974 | 0.8701 |
| 10 | 0.7623 | 0.0071 | 0.0071 | 0.0071 | 0.7694 | 0.7481 |
| 11 | 0.7686 | 0.0072 | 0.0072 | 0.0072 | 0.7758 | 0.7542 |
| 12 | 0.5198 | 0.0033 | 0.0033 | 0.0033 | 0.5165 | 0.5133 |
| 13 | 0.5922 | 0.0044 | 0.0044 | 0.0044 | 0.5878 | 0.5834 |
| 14 | 0.5072 | 0.0031 | 0.0031 | 0.0031 | 0.5041 | 0.5011 |
| 15 | 0.6206 | 0.0049 | 0.0049 | 0.0049 | 0.6157 | 0.6109 |
| 16 | 0.4221 | 0.0017 | 0.0017 | 0.0017 | 0.4204 | 0.4187 |
| 17 | 0.5292 | 0.0034 | 0.0034 | 0.0034 | 0.5258 | 0.5224 |
| 18 | 0.3875 | 0.0012 | 0.0012 | 0.0012 | 0.3863 | 0.3852 |
| 19 | 0.3339 | 0.0003 | 0.0003 | 0.0003 | 0.3336 | 0.3333 |
| 20 | 0.4662 | 0.0024 | 0.0024 | 0.0024 | 0.4638 | 0.4614 |
| 21 | 0.4316 | 0.0019 | 0.0019 | 0.0019 | 0.4297 | 0.4279 |
| 22 | 0.4095 | 0.0015 | 0.0015 | 0.0015 | 0.4080 | 0.4065 |
| 23 | 0.5985 | 0.0045 | 0.0045 | 0.0045 | 0.5940 | 0.5895 |
| 24 | 0.6300 | 0.0020 | 0.0050 | 0.0050 | 0.6350 | 0.6230 |
| 25 | 0.6300 | 0.0080 | 0.0050 | 0.0050 | 0.6350 | 0.6170 |

TABLE 2

| Example Number | nominal variance cancelling passage diameter | platen tolerance distance | variance cancelling passage minimum tolerance | variance cancelling passage maximum tolerance | maximum passage size | minimum passage size |
|---|---|---|---|---|---|---|
| 1 | 1.6002 | 0.0127 | 0.0127 | 0.0127 | 1.6129 | 1.5748 |
| 2 | 2.1443 | 0.0213 | 0.0213 | 0.0213 | 2.1656 | 2.1016 |
| 3 | 1.8322 | 0.0164 | 0.0164 | 0.0164 | 1.8486 | 1.7995 |
| 4 | 1.6882 | 0.0141 | 0.0141 | 0.0141 | 1.7023 | 1.6600 |
| 5 | 1.9922 | 0.0189 | 0.0189 | 0.0189 | 2.0112 | 1.9544 |
| 6 | 1.9282 | 0.0179 | 0.0179 | 0.0179 | 1.9461 | 1.8924 |
| 7 | 1.9122 | 0.0177 | 0.0177 | 0.0177 | 1.9299 | 1.8769 |
| 8 | 2.2243 | 0.0226 | 0.0226 | 0.0226 | 2.2469 | 2.1791 |
| 9 | 2.2563 | 0.0231 | 0.0231 | 0.0231 | 2.2794 | 2.2101 |
| 10 | 1.9362 | 0.0180 | 0.0180 | 0.0180 | 1.9543 | 1.9002 |
| 11 | 1.9522 | 0.0183 | 0.0183 | 0.0183 | 1.9705 | 1.9157 |
| 12 | 1.3202 | 0.0083 | 0.0083 | 0.0083 | 1.3119 | 1.3037 |
| 13 | 1.5042 | 0.0112 | 0.0112 | 0.0112 | 1.4930 | 1.4818 |
| 14 | 1.2882 | 0.0077 | 0.0077 | 0.0077 | 1.2804 | 1.2727 |
| 15 | 1.5762 | 0.0123 | 0.0123 | 0.0123 | 1.5639 | 1.5516 |
| 16 | 1.0721 | 0.0043 | 0.0043 | 0.0043 | 1.0678 | 1.0635 |
| 17 | 1.3442 | 0.0086 | 0.0086 | 0.0086 | 1.3355 | 1.3269 |
| 18 | 0.9841 | 0.0029 | 0.0029 | 0.0029 | 0.9812 | 0.9783 |
| 19 | 0.8481 | 0.0008 | 0.0008 | 0.0008 | 0.8473 | 0.8466 |
| 20 | 1.1841 | 0.0061 | 0.0061 | 0.0061 | 1.1781 | 1.1720 |
| 21 | 1.0961 | 0.0047 | 0.0047 | 0.0047 | 1.0914 | 1.0867 |
| 22 | 1.0401 | 0.0038 | 0.0038 | 0.0038 | 1.0363 | 1.0325 |
| 23 | 1.5202 | 0.0114 | 0.0114 | 0.0114 | 1.5088 | 1.4973 |
| 24 | 1.6002 | 0.0051 | 0.0127 | 0.0127 | 1.6129 | 1.5824 |
| 25 | 1.6002 | 0.0203 | 0.0127 | 0.0127 | 1.6129 | 1.5672 |

Exemplary dimensions for the nominal positioning shoulder diameter, concentric distance 144, minimum shoulder tolerance, maximum shoulder tolerance, electrode tolerance distance 158, minimum shoulder size 146 and maximum shoulder size 148 are provided in Table 3 (all units in inches) and Table 4 (all units in cm).

TABLE 3

| Example Number | nominal positioning shoulder diameter | concentric distance | minimum shoulder tolerance | maximum shoulder tolerance | electrode tolerance distance | minimum shoulder size | maximum shoulder size |
|---|---|---|---|---|---|---|---|
| 1 | 0.6000 | 0.0030 | 0.0050 | 0.0050 | 0.0050 | 0.5950 | 0.6130 |
| 2 | 0.8040 | 0.0050 | 0.0084 | 0.0084 | 0.0084 | 0.7956 | 0.8258 |
| 3 | 0.6870 | 0.0039 | 0.0065 | 0.0065 | 0.0065 | 0.6806 | 0.7038 |
| 4 | 0.6330 | 0.0033 | 0.0056 | 0.0056 | 0.0056 | 0.6275 | 0.6474 |
| 5 | 0.7470 | 0.0045 | 0.0075 | 0.0075 | 0.0075 | 0.7396 | 0.7664 |
| 6 | 0.7230 | 0.0042 | 0.0071 | 0.0071 | 0.0071 | 0.7160 | 0.7413 |
| 7 | 0.7170 | 0.0042 | 0.0070 | 0.0070 | 0.0070 | 0.7101 | 0.7351 |
| 8 | 0.8340 | 0.0053 | 0.0089 | 0.0089 | 0.0089 | 0.8251 | 0.8571 |
| 9 | 0.8460 | 0.0055 | 0.0091 | 0.0091 | 0.0091 | 0.8369 | 0.8697 |
| 10 | 0.7260 | 0.0043 | 0.0071 | 0.0071 | 0.0071 | 0.7189 | 0.7445 |
| 11 | 0.7320 | 0.0043 | 0.0072 | 0.0072 | 0.0072 | 0.7248 | 0.7507 |
| 12 | 0.4950 | 0.0020 | 0.0033 | 0.0033 | 0.0033 | 0.4918 | 0.5035 |
| 13 | 0.5640 | 0.0026 | 0.0044 | 0.0044 | 0.0044 | 0.5596 | 0.5754 |
| 14 | 0.4830 | 0.0018 | 0.0031 | 0.0031 | 0.0031 | 0.4800 | 0.4909 |
| 15 | 0.5910 | 0.0029 | 0.0049 | 0.0049 | 0.0049 | 0.5862 | 0.6036 |
| 16 | 0.4020 | 0.0010 | 0.0017 | 0.0017 | 0.0017 | 0.4003 | 0.4064 |
| 17 | 0.5040 | 0.0020 | 0.0034 | 0.0034 | 0.0034 | 0.5006 | 0.5128 |
| 18 | 0.3690 | 0.0007 | 0.0012 | 0.0012 | 0.0012 | 0.3679 | 0.3720 |
| 19 | 0.3180 | 0.0002 | 0.0003 | 0.0003 | 0.0003 | 0.3177 | 0.3188 |
| 20 | 0.4440 | 0.0014 | 0.0024 | 0.0024 | 0.0024 | 0.4416 | 0.4502 |
| 21 | 0.4110 | 0.0011 | 0.0019 | 0.0019 | 0.0019 | 0.4092 | 0.4158 |
| 22 | 0.3900 | 0.0009 | 0.0015 | 0.0015 | 0.0015 | 0.3885 | 0.3939 |
| 23 | 0.5700 | 0.0027 | 0.0045 | 0.0045 | 0.0045 | 0.5655 | 0.5817 |
| 24 | 0.6000 | 0.0030 | 0.0050 | 0.0050 | 0.0080 | 0.5950 | 0.6160 |
| 25 | 0.6000 | 0.0030 | 0.0050 | 0.0050 | 0.0020 | 0.5950 | 0.6100 |

TABLE 4

| Example Number | nominal positioning shoulder diameter | concentric distance | minimum shoulder tolerance | maximum shoulder tolerance | electrode tolerance distance | minimum shoulder size | maximum shoulder size |
|---|---|---|---|---|---|---|---|
| 1 | 1.5240 | 0.0076 | 0.0127 | 0.0127 | 0.0127 | 1.5113 | 1.5570 |
| 2 | 2.0422 | 0.0128 | 0.0213 | 0.0213 | 0.0213 | 2.0208 | 2.0976 |
| 3 | 1.7450 | 0.0098 | 0.0164 | 0.0164 | 0.0164 | 1.7286 | 1.7876 |
| 4 | 1.6078 | 0.0085 | 0.0141 | 0.0141 | 0.0141 | 1.5937 | 1.6445 |
| 5 | 1.8974 | 0.0114 | 0.0189 | 0.0189 | 0.0189 | 1.8785 | 1.9466 |
| 6 | 1.8364 | 0.0107 | 0.0179 | 0.0179 | 0.0179 | 1.8185 | 1.8830 |
| 7 | 1.8212 | 0.0106 | 0.0177 | 0.0177 | 0.0177 | 1.8035 | 1.8671 |
| 8 | 2.1184 | 0.0136 | 0.0226 | 0.0226 | 0.0226 | 2.0958 | 2.1771 |
| 9 | 2.1488 | 0.0139 | 0.0231 | 0.0231 | 0.0231 | 2.1257 | 2.2089 |
| 10 | 1.8440 | 0.0108 | 0.0180 | 0.0180 | 0.0180 | 1.8260 | 1.8909 |
| 11 | 1.8593 | 0.0110 | 0.0183 | 0.0183 | 0.0183 | 1.8410 | 1.9068 |
| 12 | 1.2573 | 0.0050 | 0.0083 | 0.0083 | 0.0083 | 1.2490 | 1.2788 |
| 13 | 1.4326 | 0.0067 | 0.0112 | 0.0112 | 0.0112 | 1.4214 | 1.4616 |
| 14 | 1.2268 | 0.0046 | 0.0077 | 0.0077 | 0.0077 | 1.2191 | 1.2470 |
| 15 | 1.5011 | 0.0074 | 0.0123 | 0.0123 | 0.0123 | 1.4888 | 1.5332 |
| 16 | 1.0211 | 0.0026 | 0.0043 | 0.0043 | 0.0043 | 1.0168 | 1.0323 |
| 17 | 1.2802 | 0.0052 | 0.0086 | 0.0086 | 0.0086 | 1.2715 | 1.3026 |
| 18 | 0.9373 | 0.0018 | 0.0029 | 0.0029 | 0.0029 | 0.9343 | 0.9449 |
| 19 | 0.8077 | 0.0005 | 0.0008 | 0.0008 | 0.0008 | 0.8070 | 0.8097 |
| 20 | 1.1278 | 0.0037 | 0.0061 | 0.0061 | 0.0061 | 1.1217 | 1.1436 |
| 21 | 1.0439 | 0.0028 | 0.0047 | 0.0047 | 0.0047 | 1.0392 | 1.0562 |
| 22 | 0.9906 | 0.0023 | 0.0038 | 0.0038 | 0.0038 | 0.9868 | 1.0005 |
| 23 | 1.4478 | 0.0069 | 0.0114 | 0.0114 | 0.0114 | 1.4364 | 1.4775 |
| 24 | 1.5240 | 0.0076 | 0.0127 | 0.0127 | 0.0203 | 1.5113 | 1.5646 |
| 25 | 1.5240 | 0.0076 | 0.0127 | 0.0127 | 0.0051 | 1.5113 | 1.5494 |

Exemplary dimensions for the minimum position stack-up, maximum position stack-up, maximum radial slop, minimum radial slop are provided in Table 5 (all units in inches) and Table 6 (all units in cm).

TABLE 5

| Example Number | minimum position stack-up | maximum position stack-up | maximum radial slop | minimum radial slop |
|---|---|---|---|---|
| 1 | 0.0070 | 0.0400 | 0.0200 | 0.0035 |
| 2 | 0.0016 | 0.0570 | 0.0285 | 0.0008 |
| 3 | 0.0047 | 0.0473 | 0.0236 | 0.0023 |
| 4 | 0.0061 | 0.0428 | 0.0214 | 0.0031 |
| 5 | 0.0031 | 0.0522 | 0.0261 | 0.0015 |
| 6 | 0.0037 | 0.0503 | 0.0251 | 0.0019 |
| 7 | 0.0039 | 0.0498 | 0.0249 | 0.0019 |
| 8 | 0.0008 | 0.0595 | 0.0298 | 0.0004 |
| 9 | 0.0004 | 0.0605 | 0.0303 | 0.0002 |
| 10 | 0.0036 | 0.0505 | 0.0253 | 0.0018 |
| 11 | 0.0035 | 0.0510 | 0.0255 | 0.0017 |
| 12 | 0.0098 | 0.0248 | 0.0124 | 0.0049 |
| 13 | 0.0080 | 0.0282 | 0.0141 | 0.0040 |
| 14 | 0.0101 | 0.0242 | 0.0121 | 0.0051 |
| 15 | 0.0072 | 0.0296 | 0.0148 | 0.0036 |
| 16 | 0.0123 | 0.0201 | 0.0101 | 0.0061 |
| 17 | 0.0096 | 0.0252 | 0.0126 | 0.0048 |
| 18 | 0.0132 | 0.0185 | 0.0092 | 0.0066 |
| 19 | 0.0145 | 0.0159 | 0.0080 | 0.0073 |
| 20 | 0.0112 | 0.0222 | 0.0111 | 0.0056 |
| 21 | 0.0120 | 0.0206 | 0.0103 | 0.0060 |
| 22 | 0.0126 | 0.0195 | 0.0098 | 0.0063 |
| 23 | 0.0078 | 0.0285 | 0.0143 | 0.0039 |
| 24 | 0.0070 | 0.0400 | 0.0200 | 0.0035 |
| 25 | 0.0070 | 0.0400 | 0.0200 | 0.0035 |

TABLE 6

| Example Number | minimum position stack-up | maximum position stack-up | maximum radial slop | minimum radial slop |
|---|---|---|---|---|
| 1 | 0.0178 | 0.1016 | 0.0508 | 0.0089 |
| 2 | 0.0040 | 0.1448 | 0.0724 | 0.0020 |
| 3 | 0.0119 | 0.1200 | 0.0600 | 0.0059 |
| 4 | 0.0155 | 0.1086 | 0.0543 | 0.0078 |
| 5 | 0.0078 | 0.1327 | 0.0664 | 0.0039 |
| 6 | 0.0094 | 0.1276 | 0.0638 | 0.0047 |
| 7 | 0.0099 | 0.1264 | 0.0632 | 0.0049 |
| 8 | 0.0019 | 0.1511 | 0.0756 | 0.0010 |
| 9 | 0.0011 | 0.1537 | 0.0768 | 0.0006 |
| 10 | 0.0092 | 0.1283 | 0.0641 | 0.0046 |
| 11 | 0.0088 | 0.1295 | 0.0648 | 0.0044 |
| 12 | 0.0249 | 0.0629 | 0.0314 | 0.0124 |
| 13 | 0.0202 | 0.0716 | 0.0358 | 0.0101 |
| 14 | 0.0257 | 0.0613 | 0.0307 | 0.0129 |
| 15 | 0.0184 | 0.0751 | 0.0375 | 0.0092 |
| 16 | 0.0312 | 0.0511 | 0.0255 | 0.0156 |
| 17 | 0.0243 | 0.0640 | 0.0320 | 0.0121 |
| 18 | 0.0334 | 0.0469 | 0.0234 | 0.0167 |
| 19 | 0.0369 | 0.0404 | 0.0202 | 0.0184 |
| 20 | 0.0283 | 0.0564 | 0.0282 | 0.0142 |
| 21 | 0.0306 | 0.0522 | 0.0261 | 0.0153 |
| 22 | 0.0320 | 0.0495 | 0.0248 | 0.0160 |
| 23 | 0.0198 | 0.0724 | 0.0362 | 0.0099 |
| 24 | 0.0178 | 0.1016 | 0.0508 | 0.0089 |
| 25 | 0.0178 | 0.1016 | 0.0508 | 0.0089 |

Referring to Tables 1-6, the minimum position stack-up was about 0.007 inches (about 0.018 cm) in example 1. The maximum position stack-up was about 0.040 inches (about 0.102 cm) in example 1. For example 1, the maximum radial slop was about 0.0200 inches (about 0.0508 cm) and the minimum radial slop was about 0.0035 inches (about 0.0089 cm). The largest minimum position stack-up was about 0.015 inches (about 0.038 cm) and the remaining minimum position stack-up values were less than or equal to about 0.015 inches (about 0.038 cm). The smallest maximum position stack-up was about 0.016 inches (about 0.041 cm) and the remaining maximum position stack-up values were greater than or equal to about 0.016 inches (about 0.041 cm).

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

It is noted that the term "commonly," when utilized herein, is not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure. Similarly, although some aspects of the present disclosure are identified herein as preferred or particularly advantageous, it is contemplated that the present disclosure is not necessarily limited to these preferred aspects of the invention.

Having described the invention in detail and by reference to specific embodiments thereof, it will be apparent that modifications and variations are possible without departing from the scope of the invention defined in the appended claims.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An electrode polishing assembly comprising an electrode securing platen, a plurality of electrode locating fasteners, and an electrode, wherein:

the electrode securing platen comprises an electrode facing surface, an assembly support surface, and a plurality of variance cancelling passages extending through the electrode securing platen from the electrode facing surface to the assembly support surface;

the variance cancelling passages are arranged at the electrode facing surface according to a plurality of hole-pattern locations, such that each of the variance cancelling passages are no more than a platen tolerance distance away from one of the hole-pattern locations;

each of the variance cancelling passages comprise a variance cancelling passage diameter, such that the variance cancelling passage diameter is greater than or equal to a minimum passage size and less than or equal to a maximum passage size;

each of the electrode locating fasteners comprises a threaded electrode engagement portion, an electrode spacing shoulder extending from the threaded electrode engagement portion, a variance cancelling shoulder extending from the electrode spacing shoulder, a threaded platen clamping portion extending from the variance cancelling shoulder, and a threaded nut that engages the threaded platen clamping portion;

the electrode comprises a plurality of threaded orifices arranged at a platen facing surface according to the hole-pattern locations, such that each of the threaded orifices are no more than an electrode tolerance distance away from one of the hole-pattern locations;

each of the electrode locating fasteners are engaged with the electrode and have a concentricity less than or equal to a concentric distance, such that the threaded electrode engagement portion overlaps one of the threaded orifices;

the variance cancelling shoulder comprises a positioning shoulder diameter, such that the positioning shoulder diameter is greater than or equal to a minimum shoulder size and less than or equal to a maximum shoulder size;

the electrode locating fasteners clamp the electrode securing platen between the threaded nut and the electrode spacing shoulder, such that the variance cancelling shoulder is at least partially within one of the variance cancelling passages;

a minimum position stack-up is equal to the minimum passage size minus the maximum shoulder size;

a maximum position stack-up is equal to the maximum passage size minus the minimum shoulder size; and the maximum position stack-up is greater than the minimum position stack-up.

2. The electrode polishing assembly of claim 1, wherein the minimum passage size is equal to a nominal variance cancelling passage diameter minus the platen tolerance distance minus a variance cancelling passage minimum tolerance.

3. The electrode polishing assembly of claim 1, wherein the maximum passage size is equal to a nominal variance cancelling passage diameter plus a variance cancelling passage maximum tolerance.

4. The electrode polishing assembly of claim 1, wherein the minimum shoulder size is equal to a nominal positioning shoulder diameter minus a minimum shoulder tolerance.

5. The electrode polishing assembly of claim 1, wherein the maximum shoulder size is equal to a nominal positioning shoulder diameter plus the concentric distance plus a maximum shoulder tolerance plus the electrode tolerance distance.

6. The electrode polishing assembly of claim 1, wherein the minimum position stack-up is less than or equal to about 0.015 inches (about 0.038 cm).

7. The electrode polishing assembly of claim 6, wherein the minimum position stack-up is about 0.007 inches (about 0.018 cm).

8. The electrode polishing assembly of claim 1, wherein the maximum position stack-up is greater than or equal to about 0.016 inches (about 0.041 cm).

9. The electrode polishing assembly of claim 1, wherein the maximum position stack-up is about 0.040 inches (about 0.102 cm).

10. The electrode polishing assembly of claim 1, wherein the threaded electrode engagement portion comprises a thread pitch diameter and the thread pitch diameter of at least one of the electrode locating fasteners is within a lower 30% control band of a standard thread tolerance.

11. The electrode polishing assembly of claim 10, the thread pitch diameter of each of the electrode locating fasteners is within the lower 30% control band of the standard thread tolerance.

12. The electrode polishing assembly of claim 1, wherein the variance cancelling shoulder is substantially smooth.

13. The electrode polishing assembly of claim 1, wherein the variance cancelling passages outnumber the electrode locating fasteners.

14. The electrode polishing assembly of claim 13, wherein the electrode polishing assembly consists of five or fewer of the electrode locating fasteners.

15. The electrode polishing assembly of claim 1, wherein the electrode locating fasteners comprise polypropylene.

16. The electrode polishing assembly of claim 1, wherein the threaded nut is manually disengagable from the threaded platen clamping portion as defined by a SEMI-S8 tip pinch standard.

17. The electrode polishing assembly of claim 16, wherein:

the electrode spacing shoulder comprises a spacing shoulder width;

a resting land width formed by the threaded nut and the assembly support surface;

the spacing shoulder width is greater than or equal to about 0.150 inches (about 0.381 cm);

and the resting land width is greater than or equal to about 0.190 inches (about 0.482 cm).

18. The electrode polishing assembly of claim 1, wherein an underside clearance of the threaded nut is greater than or equal to about 3 inches.

19. The electrode polishing assembly of claim 1, wherein the electrode comprises silicon.

20. An electrode polishing assembly comprising an electrode securing platen, a plurality of electrode locating fasteners, and an electrode, wherein:

the electrode securing platen comprises an electrode facing surface, an assembly support surface, and a plurality of variance cancelling passages extending through the electrode securing platen from the electrode facing surface to the assembly support surface;

the variance cancelling passages are arranged at the electrode facing surface according to a plurality of hole-pattern locations, such that each of the variance cancelling passages are no more than a platen tolerance distance away from one of the hole-pattern locations;

each of the variance cancelling passages comprise a variance cancelling passage diameter, such that the variance cancelling passage diameter is greater than or equal to a minimum passage size and less than or equal to a maximum passage size;

each of the electrode locating fasteners comprises a threaded electrode engagement portion, an electrode spacing shoulder extending from the threaded electrode engagement portion, a variance cancelling shoulder extending from the electrode spacing shoulder, a threaded platen clamping portion extending from the variance cancelling shoulder, and a threaded nut that engages the threaded platen clamping portion;

the electrode comprises a plurality of threaded orifices arranged at a platen facing surface according to the hole-pattern locations, such that each of the threaded orifices are no more than an electrode tolerance distance away from one of the hole-pattern locations;

the threaded electrode engagement portion comprises a thread pitch diameter and the thread pitch diameter of at least one of the electrode locating fasteners is within a lower 30% control band of a standard thread tolerance;

each of the electrode locating fasteners are engaged with the electrode and have a concentricity less than or equal to a concentric distance, such that the threaded electrode engagement portion overlaps one of the threaded orifices;

the variance cancelling shoulder comprises a positioning shoulder diameter, such that the positioning shoulder diameter is greater than or equal to a minimum shoulder size and less than or equal to a maximum shoulder size;

the electrode locating fasteners clamp the electrode securing platen between the threaded nut and the electrode spacing shoulder, such that the variance cancelling shoulder is at least partially within one of the variance cancelling passages;

a minimum position stack-up is equal to the minimum passage size minus the maximum shoulder size;

a maximum position stack-up is equal to the maximum passage size minus the minimum shoulder size;

the minimum passage size is equal to a nominal variance cancelling passage diameter minus the platen tolerance distance minus a variance cancelling passage minimum tolerance;

the maximum passage size is equal to the nominal variance cancelling passage diameter plus a variance cancelling passage maximum tolerance;

the minimum shoulder size is equal to a nominal positioning shoulder diameter minus a minimum shoulder tolerance;

the maximum shoulder size is equal to the nominal positioning shoulder diameter plus the concentric distance plus a maximum shoulder tolerance plus the electrode tolerance distance; and the maximum position stack-up is greater than the minimum position stack-up.

* * * * *